United States Patent [19]

Ardezzone

[11] Patent Number: 4,588,241

[45] Date of Patent: May 13, 1986

[54] SURFACE MATING COAXIAL CONNECTOR

[75] Inventor: Frank J. Ardezzone, Santa Clara, Calif.

[73] Assignee: Probe-Rite, Inc., San Jose, Calif.

[21] Appl. No.: 535,244

[22] Filed: Sep. 23, 1983

[51] Int. Cl.[4] ..... H01R 11/00

[52] U.S. Cl. ..... 339/59 M; 339/61 M; 339/177 R; 339/256 S

[58] Field of Search ..... 339/177, 255, 256, 59, 339/60, 61

[56] References Cited

U.S. PATENT DOCUMENTS

| | | | |
|---|---|---|---|
| 2,379,942 | 7/1945 | Webber | 339/60 R |
| 2,757,351 | 7/1956 | Klostermann | 339/177 R |
| 3,275,970 | 9/1966 | Johanson et al. | 339/255 R |
| 3,295,872 | 1/1967 | Kragle | 339/256 R |
| 3,340,495 | 9/1967 | Weinschel | 339/256 R |
| 3,416,125 | 12/1968 | Theve | 339/177 R |
| 4,227,765 | 10/1980 | Neumann et al. | 339/177 E |
| 4,431,242 | 2/1984 | Gisewsky | 339/255 R |

OTHER PUBLICATIONS

Heath et al., "Coaxial Connector", IBM Tech. Disclosure Bulletin, (3/1979) vol. 21, No. 10, pp. 3987–3988.

Chang et al., "Quick Disconnect Coaxial Connector" IBM . . . , vol. 20, No. 5, (10/1977) p. 1761.

*Primary Examiner*—Gil Weidenfeld
*Assistant Examiner*—David L. Pirlot
*Attorney, Agent, or Firm*—Thomas E. Schatzel

[57] ABSTRACT

A surface mating coaxial connector for use in transmitting signals to an electronic device. The connector has a contact pin electrically and mechanically connected to a central conductor of a small coaxial cable through an axially-moveable connection means. The shielding of the coaxial cable is extended from the cable over the length of the connector including the contact pin by a shield extension means which minimizes interference from adjacent contact pins. An insulation means electrically isolates the shield extension means from the contact pin and the axially-moveable connection means and is configured such that the impedance of the coaxial cable is maintained to the point of contact of the contact pin. The contact pin and a shield collar which surrounds the contact pin are independently and automatically adjustable in the axial direction to compensate for height variations of the surface on which contact is made.

15 Claims, 4 Drawing Figures

SURFACE MATING COAXIAL CONNECTOR

BACKGROUND OF THE INVENTION

1. Field of the Invention

The invention relates generally to integrated circuit test connectors and more particularly to a coaxial surface mating connector wherein the impedance of the coaxial cable is maintained to and through the point of surface contact, and electrical interference between adjacent connectors is substantially eliminated.

2. Description of the Prior Art

The practice of testing electrical characteristics of miniature electronic devices, e.g. semiconductor components, integrated circuits, components, circuits, etc., is of prime importance to the electronic device manufacturer so as to discover the performance capabilities of devices prior to and after assembly. For example, in the semiconductor industry, it is desirable to test semiconductor devices while in wafer or slice form so as to eliminate unsatisfactory components prior to assembly. The manufacturer further tests the devices after final assembly and prior to shipment for quality assurance. The end users of the devices commonly test the devices prior to installation in the equipment of which the device has become a part. Increasing demand for miniature electronic devices further dictates that there be continuing emphasis placed on the electronic industry to provide equipment capable of performing these tasks at higher rates of speed with precise accuracy.

BNC connectors have provided one means for making the connection between a coaxial cable and electronic devices. However, when it becomes desirable to make a multiplicity of connections and each such connection requires a matched impedance environment within a relatively small area, BNC connectors become impractical due to their size and the fact that they must be connected individually by twisting each connector.

Test signals can be transmitted to the various devices to be tested by using what is known in the semiconductor industry as a probe head adapter. Such a device is described in the U.S. Pat. No. 3,866,119. In that patent the "pogo pin assembly" is used to transmit test signals from a test device to a terminal pad which is electrically connected to test probes which are in physical and electrical contact with the device to be tested. While such a system is satisfactory under some conditions, the higher frequencies of test signals currently in use causes problems which deteriorate the test signal.

As the frequency of test signals increases, the problem of impedance mismatches between the test signal cable and the terminal pad rises to significant proportions. The results are signal reflections which are now considered noise. The impedance mismatch problems occur in connections which transition between the transmission cable and the socket. The present art has not been able to maintain a matched impedance environment from the cable, through the connector and contact pin down to the surface contact of the terminal pad. Currently, connectors which require high insertion forces or are unshielded are used. The high forces can damage or misalign the delicate components with which they are used, especially when large numbers are ganged together.

Another problem with the prior art is that open lines i.e., unshielded, on the distal end of the contact pin open the system to outside noise and cross-talk between adjacent conductors which interferes with and deteriorates the test signals being sent and received.

Additionally, surface contamination can prevent proper electrical contact in present technology even when physical contact exists between the mating surfaces of existing systems.

SUMMARY OF THE PRESENT INVENTION

It is therefore an object of the present invention to provide a connector which can maintain a matched impedance environment from the coaxial cable through the connector and down to the point of contact of a contact pin with a mating surface of the terminal pad.

It is a further object to provide a connector in which the shield and the contact pin are automatically and independently adjustable in an axial direction so as to compensate for height variations on the surface contacted when a plurality of connectors are used.

It is a further object to provide a connector which makes surface contact with the terminal pad and does not require high insertion forces to make the proper electrical connection.

It is a further object to provide a connector which minimizes cross-talk between adjacent connectors.

It is a further object to provide a connector which minimizes signal reflection due to any sources including impedance mismatch.

It is a further object to provide a connector which is shielded down to its point of surface contact with the terminal pad.

It is a further object to provide a connector which makes proper electrical contact with the terminal pad by removing surface contamination from the point of contact.

Briefly, the present invention includes a micro-coaxial cable with its central conductor electrically and mechanically connected to a contact pin through an axially-movable connection means. A shield means of the coaxial cable is electrically and mechanically connected to a shield extension means which in turn is similarly connected to a shield collar. An insulating means isolates the shield extension means and shield collar from central conductor, the axially-movable connection means and the contact pin. The shield extension means is mounted in a mounting block.

Extending from the mounting block is a contact pin surrounded by but insulated from the shield collar. The insulation means includes an elastomer core which surrounds the axially-moveable connection means and a portion of the contact pin. The shield collar is resiliently compressible.

When the contact pin and shield collar are brought into contact with the surface of a device or component each may be displaced axially, independently, so as to overcome elevation differences in the surface contacted when a plurality of contact pins are engaged with the surface. The shield collar has a lip which extends downward at an acute angle from the lower end of the collar such that the lip makes initial contact with the surface and then moves upward until it is flush with the lower end of the shield collar. The result of such motion is a scraping action on the surface contact removing contamination such that proper electrical connection is possible between the shield collar and the surface with which the collar comes into contact. Typically, the surface contacted is electrically connected to components, devices, circuits or other items to which it is desired to transmit a signal.

The insulation means is structured so as to maintain substantially the same impedance of the coaxial cable down and through the contact pin. Also the contact pin is shielded from electrical noise sources proximate thereto.

An advantage of the surface mating coaxial connector of the present invention is that a matched impedance environment may be maintained from the coaxial cable through the connector and down to the point of contact of a contact pin with a terminal pad.

Another advantage is that the shield collar and contact pin of the connector are independently and automatically adjustable in an axial direction to compensate for height variations on the surface contacted.

A further advantage is that high insertion forces are not required to make proper electrical connection.

A further advantage is that cross talk between adjacent connectors is minimized.

A further advantage is signal reflection due to impedance mismatch is minimized.

A further advantage is that shielding is provided down to a point of surface contact and can be brought through the mating part.

A further advantage is that proper electrical connection is enhanced by the removal of surface contamination.

These and other objects and advantages of the present invention will no doubt become obvious to those of ordinary skill in the art after having read the following detailed description of the preferred embodiments as illustrated in the various drawing figures.

IN THE DRAWING

DETAILED DESCRIPTION OF THE PREFERRED EMBODIMENTS

Figure 1:
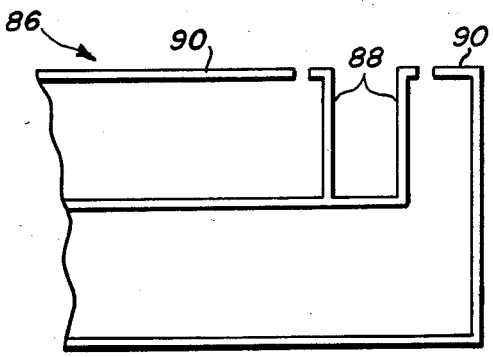
FIG. 1 is a cross sectional view of a first embodiment of a surface mating coaxial connector of the present invention.

In FIG. 1, there is illustrated a surface mating coaxial connector referred to by the general reference numeral 10 and incorporating the present invention. The surface mating coaxial connector 10 includes a micro-coaxial cable 12 comprising a central conductor 14, running along the longitudinal axis of cable 12, a dialectric core 16 surrounding the central conductor 14 and a shield means 18 surrounding the dialectric core 16. The diameter of micro-coaxial cable 12 is generally in the range of 30 to 50 mils. A connector sleeve 20 is connected to shield means 18 by a solder means 22. Connector sleeve 20 is adapted to receive conductor body 24 which in turn is mounted in a mounting block 26. Sleeve 20 is connected to body 24 by solder means 27. The connector body 24 has an annular groove 28 which is used to mount body 24 on block 26. Alternative means may be used to accomplish such mounting. Two such means are illustrated in FIG. 1. Where it is desirable to electrically connect the connector body 24 to mounting block 26, via a conductive foil 29 a solder means 30 can be used. When electrical isolation between connector body 24 and mounting block 26 is desirable, a "C" ring 32 made of a conductive material may be used, but conductive foil 29 is removed. A lower end 34 of connector body 24 is formed into a flange 36 which prevents upward axial motion of conductor body 24 with respect to mounting block 26. Downward axial motion is prevented by either solder means 30 or "C" ring 32.

A split shielding ring 37 is positioned at the upper end of connector body 24 such that split shielding ring 37 abuts a terminal end 38 of shield means 18 and an annular stop surface 40 of the connector sleeve 20. A connector pin 42 is adapted at a first end 44 to receive the central conductor 14 into a bore 46 such that pin 42 and conductor 14 are electrically connected. Solder means 47 may be used to achieve this connection.

Connector pin 42 is surrounded by a rigid insulating means 48 and an air gap 49 which electrically isolates connector pin 42 from the conductor body 24. Nonconductive epoxy may be used as said insulation means 48. When the epoxy cures it adheres to the connector pin 42 and to connector body 24.

A second end 50 of connector pin 42 is adapted to facilitate connection of a first end 52 of a single loop spring 54. In the embodiment illustrated in FIG. 1, said second end 50 is provided with a planar surface 56 on which the first end 52 of single loop spring 54 is positioned and fixed by solder means 58.

In a similar manner, a first end 60 of a contact pin 62 is provided with a planar surface 64 on which a second end 66 of the single loop spring 54 is positioned and fixed by a solder means 68. The contact pin 62 comprises a cylindrical section 70 and a bullet-shaped section 72. The contact pin 62 is electrically connected to the central conductor 14 through single loop spring 54 and connector pin 42. Surrounding the cylindrical section 70 is a nonconductive elastomer spacer core 74 which electrically isolates the cylindrical section 70 of contact pin 62 from connector body 24. The nonconductive elastomer spacer core 74 can extend downward to surround bullet-shaped section 72 so long as a tip 76 of contact pin 62 remains exposed to make electrical contact with the desired surface. The connector pin 42, single loop spring 54 and elastomer core 74 comprise an axially-movable connection means referred to by the general reference numeral 77 and which is generally coaxial with central conductor 14.

A cylindrical shield transition collar 78 is fitted within connector body 24 such that it abuts on a seat 80. Collar 78 extends downward such that a terminal end 82 is even with a distal end 83 of contact pin 62 when compressed. The configuration of cylindrical shield transition collar 78 with respect to contact pin 62 creates an air gap 84 which serves as an electrical insulator between contact pin 62 and collar 78.

Cylindrical shield transition collar 78 is electrically connected to shield means 18 through connector body 24, split stop ring 37 and connector sleeve 20. The connector body 24, stop ring 37 and connector sleeve 20 comprise a shield extension means referred to by the general reference numeral 85.

Also shown in FIG. 1 is a portion of a typical printed circuit board 86 comprising a surface contact 88 and an electrical ground 90. Surface contact 88 is comprised of conductive material which leads to a semiconductor device or other micro-electronic component to which it is desired to transmit test signals for the purpose of testing or operating the device or component. The end of micro-coaxial cable 12 opposite from that shown in FIG. 1 can be connected to a device which interfaces the necessary signals. When testing is desired, the mounting block 26 is moved such that contact pin 62 is brought into electrical contact with surface 88 which in effect permits signals on the central conductor 14 to be conducted through the interface.

Figure 2:
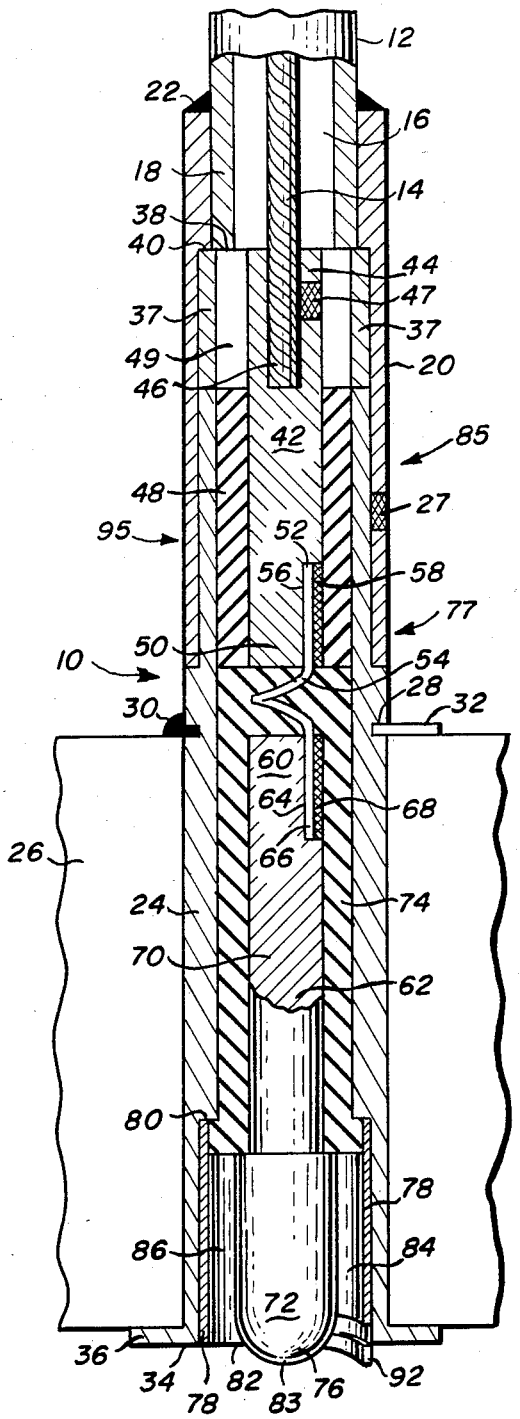
FIG. 2 is a side view of a cylindrical, shield transition collar as used in the surface mating coaxial connector of FIG. 1.
Figure 2:
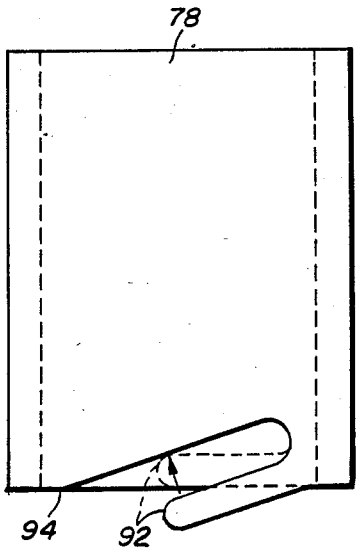

As contact pin 62 and cylindrical shield transition collar 78 make contact with the contact surface 88 and electrical ground 90, respectively, the pin 62 and collar 78 may move independently in an axial direction. By permitting such independent movement the effect of height differences between the contact surface 88 and the planar surface of the electrical ground 90 is minimized. This is particularly important where a plurality of surface mating coaxial connectors are used as a group simultaneously. As illustrated in FIG. 2, the transition collar 78 is provided with a lip 92 which moves upward when contact with a surface is made such that collar 78 is resiliently compressible. The movement of lip 92 causes the scraping of the surface electrical ground 92 which causes removal of any surface contamination present. This ensures proper electrical contact of the collar 78 with ground 92. The collar 78 may also be constructed of a conductive elastomer material. The range of motion is typically between 5 and 10 mils but can be 0 to 20 mils. At the point of greatest movement the lip 92 is flush with a lower edge 94 of collar 78.

Figure 3:
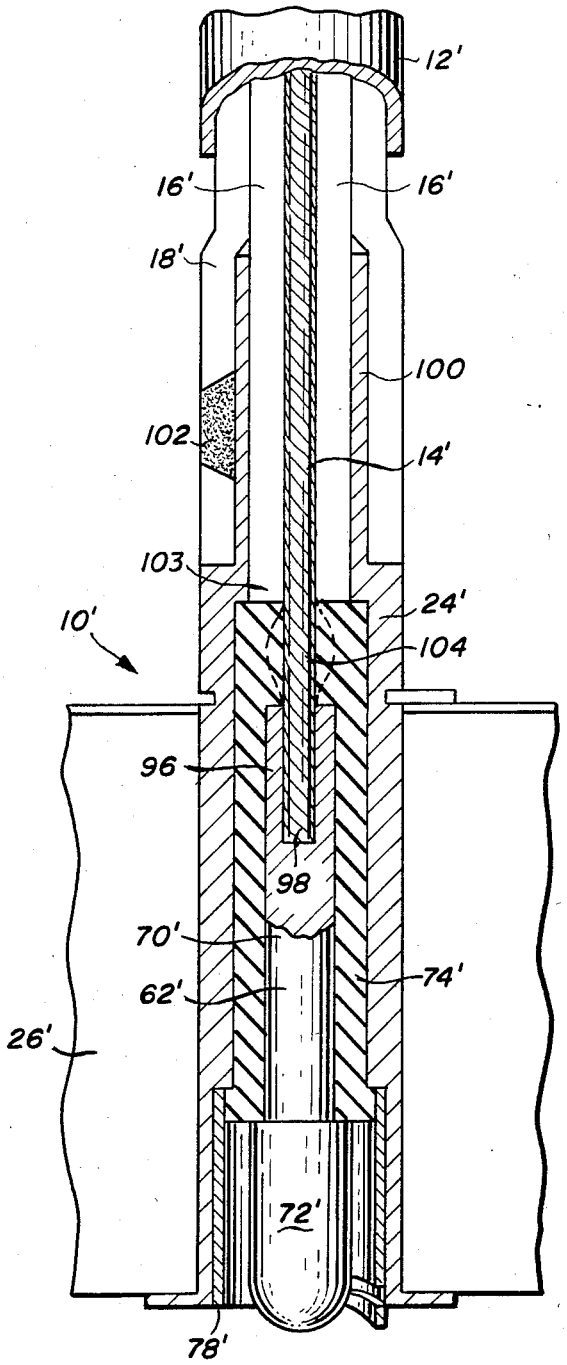
FIG. 3 is a cross sectional view of a second embodiment of a surface mating coaxial connector of the present invention.
Figure 3:
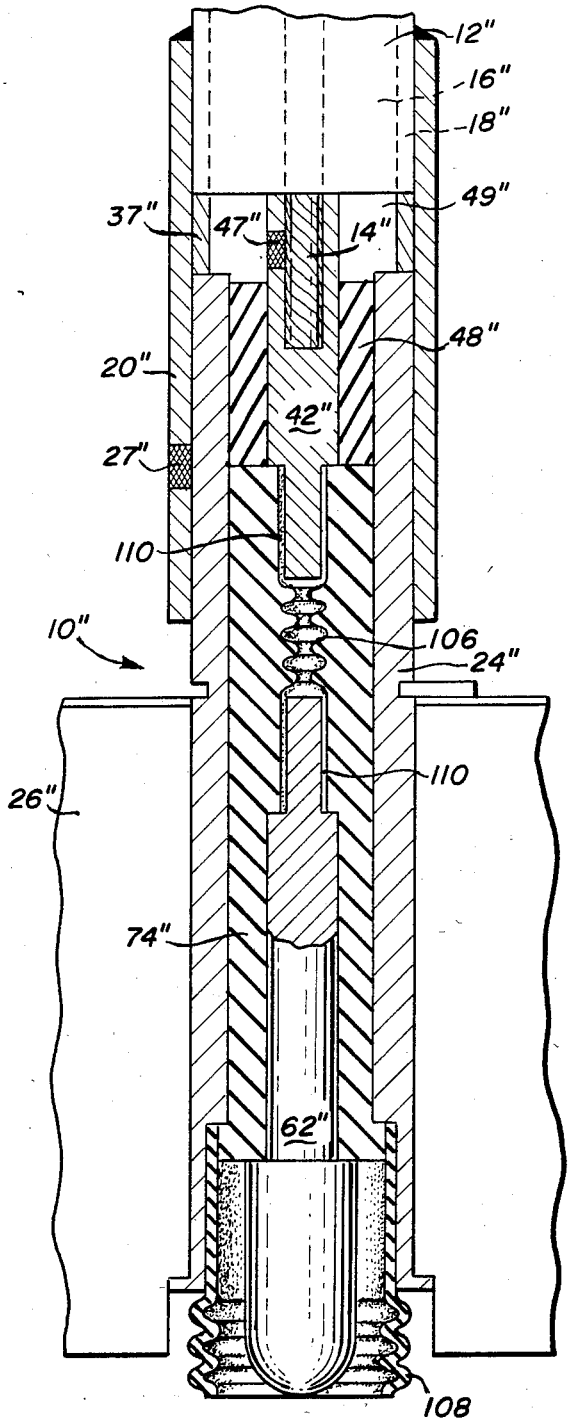
Figure 3:
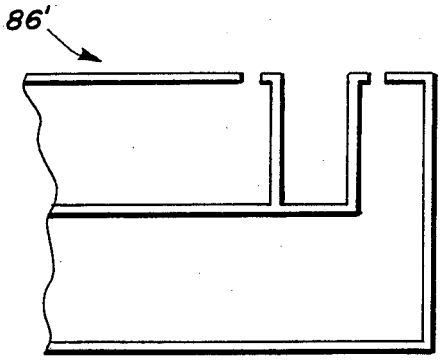
Figure 4:
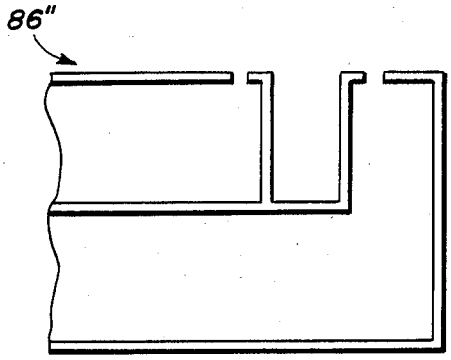
FIG. 4 is a cross sectional view of a third embodiment of a surface mating coaxial connector of the present invention.

When the contact pin 62 meets the surface contact 88, it tends to move axially upward. Its actual travel is typically between 5 and 10 mils but can be 0 to 20 mils. The axial movement is possible because the contact pin 62 is encased in elastomer spacer core 74 which is compressible permitting contact pin 62 to move axially. The distal end 83 of contact pin 62 has a spherical surface which comes into contact with surface contact 88. Surface contact 88 as illustrated is a hollow cylinder such that actual contact between contact pin 62 and surface contact 88 occurs at the upper edge of the cylinder. This configuration permits the surface area in contact with contact pin 62 to increase exponentially as said distal end 83 enters the cylinder causing the edges of the cylinder to be crushed down slightly, i.e., 0.5 to 3 mils. This reduces the penetration of the contact pin 62 into surface contact 88 while promoting proper electrical connection between the two. In conjunction with elastomer spacer core 74, single loop spring 54 is compressed. The force exerted on contact 62 must primarily overcome the modulus of compressibility of the elastomer spacer core 74 rather than that of single loop spring 54. As long as there is an electrical connection between the contact pin 62 and the central conductor 14 any axially-movable connection means which permits independent axial movement of contact pin 62 with respect to surface contact 88 is sufficient to accomplish the desired compensation for height variation of the surfaces contacted by a plurality of connectors 10. Other configurations of such axially-moveable connections means are illustrated in FIGS. 3 and 4 and are described below.

The physical arrangement of the conductive materials with respect to the insulating materials given the dielectric characteristics of insulating material is designed such that the impedance of the micro-coaxial cable 12 is maintained through the surface mating connector 10. The rigid insulating means 48, the elastomer spacer core 74 and air gap 84 comprise an insulating means referred to by the general reference numeral 95. With cable and connector impedance value being known and controllable it is possible to select a surface with impedance which matches that of the cable and connector. The result is a minimizing of signal reflection due to impedance mismatch and the reduction of interference among adjacent contact pins by shielding the pin up to and including the contact with the mating surface.

In the following description of other preferred embodiments of the present invention the primed and doubled primed symbols will be used when describing items which are structurally and functionally similar to those described above. In FIG. 3 there is illustrated a second embodiment of a surface mating coaxial connector referred to by the general reference numeral 10' and incorporating the present invention The main difference between connector 10 and connector 10' is the configuration of the axially-movable connection means. Connector 10' includes a contact pin 62' of which a first end 96 is adapted to receive a terminal end 98 of a central conductor 14' of a micro-coaxial cable 12'. In this embodiment central conductor 14' must be made of braided wire. Typically solder is used to fasten and electrically connect central conductor 14 inside contact pin 62' although crimping can be used. Central conductor 14' is electrically isolated from a shield means 18' by a dielectric core 16'.

A connector body 24' is mounted on a mounting block 26' in the manner discussed in the description of the first embodiment of the present invention. An upper end 100 of connector body 24' is inserted into cable 12' between dielectric core 16' and shield means 18' and connected mechanically and electrically to shield means 18' by solder means 102.

Contact pin 62' has a cylindrical section 70' and a bullet-shaped section 72'. The volume between connector body 24' and cylindrical section 70' is filled with a non-conductive elastomer spacer core 74'. Spacer core 74' extends past end 96 up to a terminal end 103 of dielectric core 16'. Between terminal end 103 and first end 96 of contact pin 62' there is a section 104 of central conductor 14' which is also surrounded by spacer core 74'.

A cylindrical shield transition collar 78' is of identical construction and function as collar 78 illustrated in FIG. 1 and 2 and described in the discussion concerning the first embodiment of the present invention.

When surface mating coaxial connector 10' is put into operation by bringing contact pin 62' into surface contact with the appropriate surface of a printed circuit board 86' as previously discussed, contact pin 62' is capable of axial movement due to the flexing of section 104 of the central conductor 14' (shown in phantom in FIG. 3) when the modulus of compressibility of elastomer spacer core 74' is overcome.

The impedance of cable 12' is maintained to the point of contact of the contact pin 62' in the manner previously discussed.

In FIG. 4, there is illustrated a third embodiment of a surface mating coaxial connector referred to by the general numeral 10'' and incorporating the present invention. Surface mating coaxial connector 10'' comprises a coaxial cable 12'' which includes a central conductor 14'', a dielectric core 16'' and shielding means 18''; a connector sleeve 20'', a connector body 24'', a mounting block 26'', a connector pin 42'', a rigid insulting means 48'' an air gap 49'', split shielding ring 37'', an interconnect bellows 106, a non-conductive elastomer spacer core 74", a contact pin 62" and a cylindrical corrugated shield transition collar 108. Solder means 27" and 47" are used as described above for solder means 27 and 47.

Unless discussed below, the structure and function of the components of connector 10" are similar to that which was discussed above in connection with the first and second embodiments. The main difference between the third embodiment and the first and second embodiment is the structure of the axially-movable connection means which uses conductive bellows.

The respective adjacent ends of connector pin 42" and contact pin 62" are adapted to receive a pair of sleeves 110 of interconnect bellows 106. The sleeves 110 are rigidly fixed to the respective pins so as to provide an electrical connector there between. Solder may be used to accomplish this. The interconnect bellows 106 is surrounded by the elastomer spacer core 74". A portion of contact pin 62 is also surrounded by core 74" as is illustrated in FIG. 4 and was described previously for pins 62 and 62'.

When sufficient force is applied to contact pin 62" the modulus of compressibility of elastomer spacer core 74" is overcome and interconnect bellows 106 compresses as contact pin 62" is displaced axially. When the force on contact pin 62" is removed the elastomer spacer core 74 expands causing contact pin 62" to return to its original position and interconnect bellows 106 to expand to its original configuration. Electrical connection is between connector pin 42" and contact pin 62" is maintained at all times through interconnector bellows 106. Another difference in the third embodiment is the structure of collar 108. The collar 108 is corrugated such that it can be displaced axially when force is applied. As with bellows 106, when force is removed the corrugated shield transition collar 108 will expand to its original configuration which is shown in FIG. 4.

Although the present invention as been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

I claim:

1. A surface mating coaxial connector, comprising:

a microcoaxial cable including at least a hollow cylindrical conductive shield means, insulated from a cylindrical central conductor by a dielectric material;

a contact pin having a right cylindrical proximal end and a hemispherical distal end;

an axially movable connection means through which said central conductor and the contact pin are mechanically and electrically connected such that axial motion of the contact pin in the direction of the central conductor is possible when an axial force is exerted on the contact pin and such that the contact pin returns to its original position when such force is removed, the axially movable connection means comprising a right cylindrical connector pin having a flat proximal end including an aperture for receiving said central conductor in an abutting manner and a flat distal end which abuts and is mechanically and electrically connected to a first end of an interconnect bellows, a second end of said interconnect bellows abutting and being mechanically and electrically connected to a flat proximal end of the contact pin;

a hollow right cylindrical shield collar coaxial with and surrounding a distal end of the contact pin, but electrically insulated therefrom, said collar being resiliently compressible in an axial direction such that axial motion of the collar, independent of any axial motion of the contact pin, is possible when axial force is exerted on the shield collar, the shield collar including a conductive shield extension means formed thereto for maintaining an electrical contact with the shield collar during axial motion thereof;

an insulating means in contact with said dielectric material and electrically insulating said shield extension means and shield collar from the central conductor, the axially movable connection means and the contact pin, said flat abutting surfaces of said central conductor, the axially movable connection means and the contact pin being substantially perpendicular to an axis of motion of the axially movable connection means such that the transmission impedence to a signal traveling from the central conductor through the axially movable connection means and to and through a terminal end of the contact pin remains substantially the same as the coaxial cable, said insulating means including an elastomer core surrounding said axially movable connection means and a portion of the contact pin such that axial force applied to the contact pin is transmitted to the elastomer core which can be resiliently compressed permitting axial movement of the contact pin;

whereby the contact pin may be brought into contact with the surface with which it is desired to transmit signals through the contact pin to devices, circuits, components or other items electrically connected to the surface with which contact is made;

the contact pin is electrically shielded by the shield collar to minimize interference from electrical noise sources proximate to the contact pin; and a transmission impedence of the connector is substantially the same as that of the coaxial cable such that the impedence of the surface with which the contact is made may be matched to that of the connector resulting in substantially elimination of signal reflection due to impedance mismatch.

2. The device of claim 1, wherein said axially-moveable connection means is coaxial with the central conductor.

3. The device of claim 1, wherein said shield collar is formed from a conductive elastomer.

4. A surface mating coaxial connector for use in making electrical connections for the transmission of signals to miniature electronic devices through contact surfaces approximately ten mils square comprising:

a microcoaxial cable including at least a hollow right cylindrical conductive shield means, insulated from a right cylindrical central conductor by a dielectric material;

a contact pin of greater diameter than and coaxial with said central conductor, the contact pin having a right cylindrical proximal end and a hemispherical distal end;

an axially movable connection means through which said central conductor and the contact pin are mechanically and electrically connected such that axial motion of the contact pin in the direction of said central conductor is possible when an axial force is exerted on the contact pin and such that the contact pin returns to its original position when said force is removed, the axially movable connection means comprising a right cylindrical connector pin having a flat proximal end and including an aperture for receiving said central conductor in an abutting manner, and a flat distal end abutting and connected to a first end of a single loop spring-like connector, said spring-like connector having a second end abutting and connected to the contact pin;

a right cylindrical shield collar coaxial with and surrounding said distal end of the contact pin but electrically insulated therefrom, said collar formed to be resiliently compressible in the axial direction such that axial motion of the collar, independent of any axial motion of the contact pin is possible when axial force is inserted on the shield collar, the shield collar further including a conductive shield extension means formed thereto for maintaining an electrical contact with the shield collar during axial motion thereof;

an insulating means in contact with said dielectric material and electrically insulating said shield extension means and shield collar from said central conductor, said flat abutting surfaces of the axially movable connection means, the contact pin and the central conductor being perpendicular to an axis of motion of the axially movable connection means such that the transmission impedance to a signal traveling from the central conductor through the axially movable connection means and to and through a terminal end of the contact pin remains substantially the same as that of the coaxial cable, said insulating means including an elastomer core surrounding said axially movable connection means and a portion of the contact pin such that axial force applied to the contact pin is transmitted to the elastomer core which can be resiliently compressed permitting axial movement of the contact pin;

whereby the contact pin and the shield collar may be brought into contact with the surface which which it is desired to transmit signals through the contact pin to miniature devices, circuits, components or other items electrically connected to the surface with which contact is made;

the contact pin is electrically shielded by the shield collar to minimize interference from electrical noise sources proximate to the contact pin; and the transmission impedance of the connector is substantially the same as that of the coaxial cable such that the impedance with which contact is made may be matched to that of the connector resulting in substantial elimination of signal reflection due to impedance mismatch.

5. The device of claim 4 wherein the axially movable connection means is coaxial with the central conductor.

6. The device of claim 4, wherein said axial motion of said contact pin and the shield collar are between 0 and 20 mils at a maximum.

7. The device of claim 4, wherein said micro-coaxial cable has an outside diameter of 70 mils or less.

8. A surface mating coaxial connector comprising:

a microcoaxial cable including a hollow right cylindrical conductive shield means, insulated from the right cylindrical conductor by a first dielectric material;

a contact pin of greater diameter than said central conductor, the contact pin having a right cylindrical proximal end for connection to said central conductor and a hemispherical distal end for contacting a test surface;

an axially movable connection means through which said central conductor and said contact pin are mechanically and electrically connected such that axial motion of the contact pin in the direction of said central conductor is possible when an axial force is exerted on the contact pin, and such that the contact pin returns to its original position when said force is removed, the axially movable connection means comprising a right cylindrical connector pin having a flat proximal end including an aperture for receiving said central conductor in an abutting manner, and a flat distal end abutting and connected to a first end of a single loop spring-like connector, said spring-like connector having a second end abutting and connected to the contact pin;

a hollow right cylindrical shield collar coaxial with and surrounding said distal end of the contact pin and electrically insulated therefrom, said collar including a transversely corregated section such that axial motion of the collar, independent of axial motion of the contact pin, is possible when axial force is exerted on the shield collar, the shield collar further including a conductive shield extension means formed thereto for maintaining an electrical contact with the shield collar during axial motion thereof;

an insulating means in contact with said dielectrical material and electrically insulating said shield extension means and shield collar, the axially movable connection means and the contact pin from the central conductor such that the transmission impedence to a signal traveling from said central conductor through the axially movable connection means and to and through said distal end of the contact pin remains substantially the same as that of the coaxial cable, said insulating means including an elastomer core surrounding said axially movable connection means and a proximal portion of the contact pin such that axial force applied to the contact pin is transmitted to the elastomer core which can be resiliently compressed permitting axial movement of the contact pin;

whereby the contact pin and the shield collar may be brought into contact with the surface to which it is desired to transmit signals through the contact pin;

the contact pin is electrically shielded by the shield collar to minimize interference from electrical noise such as proximate to the contact pins; and the transmission impedance of the connector is substantially the same as that of the coaxial cable.

9. A surface mating coaxial connector comprising:

a microcoaxial cable including a hollow right cylindrical conductive shield means insulated from a right cylindrical central conductor by a dielectric material;

a contact pin of greater diameter than said central conductor and having a solid right cylindrical proximal end for connecting to said central conductor and a hemispherical distal end for contacting a test surface;

an axially movable connection means through which said central conductor and said contact pin are mechanically and electrically connected such that axial motion in the direction of said central conductor is possible when an axial force is exerted on the contact pin such that the contact pin returns to its original position when said force is removed;

a hollow right cylindrical shield collar coaxial with and surrounding said distal end of the contact pin and electrically insulated, said collar including a lip extension formed to a distal end thereof such that said lip acts as a spring and compresses when contact is made with said test surface, the shield collar further including a hollow right cylindrical elastomeric conductive shield extension means formed thereto for maintaining an electrical contact with the shield collar during axial motion thereof;

an insulating means in contact with said dielectric material and electrically insulating said shield extension means and shield collar, the axially movable connecting means and the contact pin from said central conductor such that the transmission impedance to a signal traveling from said central conductor through the axially movable connection and to and through said distal end of the contact pin is substantially matched to that of the coaxial cable said insulating means including an elastomer core surrounding said axially movable connection means and a proximal portion of the contact pin such that axial force applied to the contact pin is transmitted to the elastomer core which can be resiliently compressed permitting axial motion of the contact pin;

whereby the contact pin and shield collar may be brought into contact with the surface to which it is desired to transmit signals through the contact pin;

the contact pin electrically shielded by the shield collar to minimize interference from electrical noise sources proximate to the contact pin; and the transmission impedance of the connector is substantially the same as that of the coaxial cable.

10. The device of claim 9 wherein the axially movable connection means comprises a right cylindrical connector pin having a flat proximal end including an aperture for receiving said central conductor in an abutting manner, and a flat distal end abutting and connected to the first end of a single loop spring-like connector, said spring-like connector having a second end abutting and connected to the contact pin, each abutting surface formed to be perpendicular to said axis of motion of the connection means.

11. A surface mating coaxial connector for use in making electrical connections for the transmission of signals to miniature electronic devices through contact surfaces approximately ten mils square, comprising:

a microcoaxial cable including at least a hollow right cylindrical conductive shield means, insulated from a right cylindrical central conductor by a dielectric material;

a contact pin, of greater diameter than said central conductor and having a right cylindrical proximal end for connecting to said central conductor and a hemispherical distal end for contacting a test surface;

an axially movable connection means through which said central conductor and the contact pin are mechanically and electrically connected, the connection means including a cylindrical connector pin having a flat proximal end including an aperture for receiving said central conductor in an abutting manner, and a flat distal end abutting and connected to a first end of an interconnect bellows, said interconnect bellows having a second end abutting and connected to a flat proximal end of the contact pin;

a hollow right cylindrical shield collar coaxial with and surrounding said distal end of the contact pin and electrically insulated therefrom, said collar formed to be resiliently compressible in an axial direction such that axial motion of the collar, independent of any axial motion of the contact pin, is possible when axial force is exerted on the shield collar, the shield collar further including a conductive shield extension means formed thereto for maintaining an electrical contact with the shield collar during axial motion thereof;

an insulating means in contact with said dielectric material and electrically insulating said shield extension means and shield collar from said central conductor, the axially movable connection means and the contact pin, said flat abutting surfaces of said central conductor, the axially movable connection means and the contact pin being substantially perpendicular to an axis of motion of the axially movable connection means such that the transmission impedance to a signal traveling from the central conductor to and through said distal end of the contact pin remain substantially the same as that of the coaxial cable, said insulating means including an elastomer core surrounding said axially movable contact means and a proximal portion of the contact pin such that axial force applied to the contact pin is transmitted to the elastomer core which can be resiliently compressed, permitting axial movement of the contact pin;

whereby the contact pin and the shield collar may be brought into contact with a surface with which it is desired to transmit signals through the contact pin to miniature devices, circuits, components or other items electrically connected to the surface with which contact is made;

the contact is electrically shielded by the shield collar to minimize interference from electrical noise sources proximate to the contact pin; and the transmission impedance of the connector is substantially the same as that of the coaxial cable such that the impedance with which contact is made may be matched to that of the connector resulting in substantial elimination of signal reflection due to impedence mismatch.

12. A surface mating coaxial connector for use in making electrical connections for the transmission of signals to miniature electronic devices through contact surfaces approximately ten mils square comprising:

a microcoaxial cable including at least a hollow right cylindrical conductive shield means, insulated from a right cylindrical central conductor by a dielectric material;

a contact pin of greater diameter than and coaxial with said central conductor, the contact pin having a right cylindrical proximal end and a hemispherical distal end;

an axially movable connection means through which said central conductor and the contact pin are mechanically and electrically connected such that axial motion of the contact pin in the direction of said central conductor is possible when an axial force is exerted on the contact pin and such that the contact pin returns to its original position when said force is removed, the axially movable connection means comprising a braided wire central conductor having a compressible section intermediate to the contact pin and a terminal end of the dielectric material of the coaxial cable;

a right cylindrical shield collar coaxial with and surrounding said distal end of the contact pin but electrically insulated therefrom, said collar formed to be resiliently compressible in the axial direction such that axial motion of the collar, independent of any axial motion of the contact pin is possible when axial force is inserted on the shield collar, the shield collar further including a conductive shield extension means formed thereto for maintaining an electrical contact with the shield collar during axial motion thereof;

an insulating means in contact with said dielectric material and electrically insulating said shield extension means and shield collar from said central conductor, said flat abutting surfaces of the axially movable connection means, the contact pin and the central conductor being perpendicular to an axis of motion of the axially movable connection means such that the transmission impedance to a signal traveling from the central conductor through the axially movable connection means and to and through a terminal end of the contact pin remains substantially the same as that of the coaxial cable, said insulating means including an elastomer core surrounding said axially movable connection means and a portion of the contact pin such that axial force applied to the contact pin is transmitted to the elastomer core which can be resiliently compressed permitting axial movement of the contact pin;

whereby the contact pin and the shield collar may be brought into contact with the surface which which it is desired to transmit signals through the contact pin to miniature devices, circuits, components or other items electrically connected to the surface with which contact is made;

the contact pin is electrically shielded by the shield collar to minimize interference from electrical noise sources proximate to the contact pin; and the transmission impedance of the connector is substantially the same as that of the coaxial cable such that the impedance with which contact is made may be matched to that of the connector resulting in substantial elimination of signal reflection due to impedance mismatch.

13. The device of claim 12 wherein the axially movable connection means is coaxial with the central conductor.

14. The device of claim 12 wherein said axial motion of the contact pin is between zero and twenty mils.

15. The device of claim 12 wherein said microcoaxial cable has an outside diameter of seventy mils or less.

* * * * *